US006669816B1

(12) United States Patent
Poch et al.

(10) Patent No.: US 6,669,816 B1
(45) Date of Patent: Dec. 30, 2003

(54) PROCESS FOR THE MANUFACTURE OF COATED LIQUID PACKAGING BOARD

(75) Inventors: Juan José Costas Poch, Barcelona (ES); Josep Lluis Bisbal Tudela, Sant Cugat del Vallès (ES)

(73) Assignees: Erplip S.A., Barcelona (ES); Kemira Iberica S.A., Barcelona (ES)

( * ) Notice: Subject to any disclaimer, the term of this patent is extended or adjusted under 35 U.S.C. 154(b) by 0 days.

(21) Appl. No.: 09/719,581

(22) PCT Filed: Nov. 20, 1998

(86) PCT No.: PCT/ES98/00316

§ 371 (c)(1),
(2), (4) Date: Dec. 14, 2000

(87) PCT Pub. No.: WO99/67464

PCT Pub. Date: Dec. 29, 1999

(30) Foreign Application Priority Data

Jun. 25, 1998 (ES) ..... P 9801400

(51) Int. Cl.[7] ..... D21H 17/33

(52) U.S. Cl. ..... 162/164.1; 162/168.3; 162/181.5; 162/181.7; 162/183

(58) Field of Search ..... 162/164.1, 168.3, 162/181.5, 181.7, 183

(56) References Cited

U.S. PATENT DOCUMENTS 4,522,686 A 6/1985 Dumas ..... 162/158
4,816,073 A * 3/1989 Helmer et al. ..... 106/238
6,022,448 A * 2/2000 Eriksson et al. ..... 162/123

FOREIGN PATENT DOCUMENTS

| | | | |
|---|---|---|---|
| DE | 3338087 | * | 7/1984 |
| EP | 0 275 851 | | 7/1988 |
| EP | 0 369 328 | | 5/1990 |
| WO | WO 94/01619 | | 1/1994 |
| WO | WO 96/35841 | | 11/1996 |

* cited by examiner

*Primary Examiner*—Dean T. Nguyen
(74) *Attorney, Agent, or Firm*—Finnegan, Henderson, Farabow, Garrett, & Dunner, L.L.P.

(57) ABSTRACT

The process contemplates the use of a sizing dispersion that comprises an aqueous dispersion of rosin material, a synthetic sizing agent and a aluminum compound selected from the group formed by aluminum sulfate and aluminum polymers of formulas $$[Al(OH)_x(A)_{(3-x)}]_n \quad (1)$$

or $$[Al(OH)_x(H_3PO_4)_y(A)_{(3-x)}]_n \quad (2)$$

where A=$Cl^-$, $NO_3^-$, $HCOO^-$, $CH_3COO^-$;
or $$[Al(OH)_x(H_3PO_4)_y(SO_4)_{(3-x/2)}]_n \quad (3)$$

where "x" ranges from 0.03 to 2.7, and "y" ranges from 0.01 to 0.8 and $n \geqq 2$;
and by mixtures thereof.

8 Claims, No Drawings

PROCESS FOR THE MANUFACTURE OF COATED LIQUID PACKAGING BOARD

FIELD OF THE INVENTION

The present invention relates to a process for the manufacture of coated liquid packaging board, of the type using a sizing dispersion comprising an aqueous dispersion of rosin material, a synthetic sizing agent and an aluminum compound.

PRIOR ART REFERENCE

One of the main characteristics of paper and similar products is water-repellency or resistance to the penetration of water or other liquids, such as lactic acid, hydrogen peroxide solutions, etc. The main processes to confer hydrophobic properties on paper are stock sizing which affects the whole structure of the paper, surface sizing, more or less limited to the surface thereof, and combinations of both methods. The more common hydrophobic agents in stock sizing are rosins, synthetic sizing agents, such as alkyl ketene dimers, isocyanates, acid anhydrides and carbamoyl chloride and combinations of both components.

It has been observed recently, however, that in liquid packaging board the initial resistance to the edge penetration of solutions of lactic acid and hot hydrogen peroxide obtained with the traditional methods or products, is not maintained after a process of coating or conversion of the cardboard, a fact that causes financial and handling problems, and problems for the end user.

It should be borne in mind that coating is a rather complex treatment. The size of the fibers (0.1 to 3 mm) forming the paper leads to an irregular surface causing differences, throughout the sheet, in porosity, absorption, compressibility and printability. To make the surface uniform and improve the afore named properties, the paper or board is subjected to a coating process. Coating means applying to the surface a suspension composed of a binder or binders (latex, carboxy methyl cellulose, alginates, starches), pigments (inorganic compounds of the calcium carbonate type, kaolin, titanium dioxide), as well as other ancillary reagents to confer specific properties on the paper or board (whiteners, starches, sizing agents, etc). After the coated paper or board is dried and calendered, a uniform surface containing only micropores is obtained (unlike the macropores of the non coated paper or board).

The purpose of the coating is to confer specific properties, unlike those observed in the non coated paper or board: better appearance, less dimensional variance, improvement of optical properties (greater whiteness, opacity, gloss), improvement of the printing properties (greater clarity, less transparency on the back, deeper and more contrasted colors, less ink consumption), increase in hydrophobic properties, improvement of the mechanical properties (smoothness, strength), etc. It also involves a financial improvement on increasing the weight of the paper or board, with a surface layer, not formed by cellulose and cheaper. In general, where the properties of coated papers are concerned, further to the features in common with other papers, the properties derived from the coating have to be considered. The features of the coating layer depend on:

Composition of the coating liquid mixture or formula used (type of components and mutual proportions.

Amount of layer applied.

Application process (type of coating machine and drying system).

Mechanical finish or enhancement (calendering, brushing)

Some of the specific properties of the coated paper or board, already hinted at above, are:

Good tearing-off strength.

Water resistance

Low absorbency.

Very smooth surface.

Elasticity.

Opacity to avoid transparency.

Alkaline pH to avoid delay in ink drying.

Water insoluble components.

The support paper on which the coating is applied represents 70% of the weight (90% of the volume), while the coating layer represents the remaining 30% (25% pigments and 5% binders).

The applications of coated and non coated papers and boards are also different. The latter are directed to products having less added value, whereas the coated papers and boards have a better quality, higher value and are directed to a market segment also of higher quality. In this sense, the printing requirements are more demanding (definition of print, gloss, intensity and ink drying) or resistance to certain chemical agents (lactic acid and peroxides, such as is the case of coated board for packaging liquids, water, fats, etc) is needed.

It has been indicated that the stock sizing with rosin cationic sizes, such as those described in the documents ES-8900750. GB-2159153, EP-0 200 002, U.S. Pat. No. 3,966,654 and U.S. Pat. No. 4,199,369, or with a conventional anionic rosin size (emulsion, pastes or soap) gives the finished paper a good resistance to water penetration. They have, however, disadvantages such as certain pH and temperature limitations, the difficulty of conferring a good resistance to acid liquid penetration on the paper or the need to be used in comparatively high amounts to obtain a satisfactory degree of sizing. On the other hand, rosin dispersions are widely used and cannot be replaced by synthetic sizing agents in certain circumstances. Thus, for example, the rosin dispersions confer a good adhesion to the rolling cylinder, providing a better gloss of the paper.

The synthetic sizing agents react with the cellulose to give an irreversible bond. Although said sizing agents generally confer a good resistance both to water and to other liquids, they also suffer from certain drawbacks. For example, the sizing process should be carried out in a neutral or lightly alkaline medium (pH between 7 and 8.5) to be effective, hydrolysis reactions and loss of effectiveness can take place in water and it is not possible to achieve a good resistance to edge penetration of hot peroxide solutions. Also, some printing properties are relatively poor.

It is known that the combination of rosin and some synthetic sizing agents allows more generally applicable sizing agents to be obtained, a fact that allows to some of the above mentioned drawbacks to be overcome, when both components are used individually. For example, EP-A-0 074 544 describes a sizing method using cationic dispersions that contain as disperse phase particles of fortified rosin as well as particles of synthetic sizing agent. EP-0 275 851 describes a sizing method using of the above described anionic and cationic dispersions which also contain a polyaluminum compound. EP-0 693 589 describes a sizing method for paper and similar cellulose products containing precipitated calcium carbonate as filler, with the use of the above named dispersions. In WO 96/35841, a water-soluble inorganic alkali metal salt is added to improve the stability of cationic dispersions of agents based on rosin sizes or synthetic sizing agents. U.S. Pat. No. 4,522,686 describes a sizing dispersion formed by a synthetic sizing agent, fortified rosin and a water-soluble dispersing agent with nitrogen in its composition, the latter two being the components of a cationic rosin size. EP-A-0 292 975 describes a method to be used in the production of liquid packaging board. SU 1795994 describes a process for increasing the resistance to attack by hot hydrogen peroxide that comprises the successive addition of an alkylketenedimer emulsion and a rosin glue with an Al compound. In the above mentioned publications, nevertheless, at no time is there suggested the existence of any problem caused by a decrease in the resistance to edge penetration by lactic acid or hot hydrogen peroxide solutions after a coating or conversion process, that is to say, the board is within specifications in the reel but, after the said coating or conversion process, said resistance diminishes until reaching a level at which it remains constant.

Nevertheless, it has been observed that this drawback does really exist in coated boards. A negative interaction appears between the coating layer and the cellulose in this type of board when sized with the methods or products described up to now. This interaction involves a loss of the board's strength to lactic acid and peroxide over time. These parameters are very important in the end product quality, since they allow it to be sterilized (performed with peroxides and absolutely necessary since it is a question of board for packs which have to contain food products), as well as the application in the packaging of milk (resistance to lactic acid).

The usual production process of coated board includes the application of separate dispersions containing, one of them, an anionic rosin dispersion and an aluminium salt, and the other one, the AKD dispersion. Both dispersions have different pH values (the anionic rosin dispersion and the aluminium salt is an acid solution, while the AKD dispersion is neutral or slightly basic), and are used successively.

SUMMARY OF THE INVENTION

It is an object of the invention to overcome the above mentioned drawbacks; said object is achieved by a process of the type indicated at the beginning and wherein said aluminum compound is chosen from the group formed by aluminum sulfate and by aluminum polymers of general formula 1, by polymers of general formula 2

$$[Al(OH)_x(A)_{(3-x)}]_n \quad (1)$$

by polymers of general formula2

$$[Al(OH)_x(H_3PO_4)_y(A)_{(3-x)}]_n \quad (2)$$

where A=$Cl^-$, $NO_3^-$, $HCOO^-$, $CH_3COO^-$;

and by polymers of general formula 3

$$[Al(OH)_x(H_3PO_4)_y\ (SO_4)_{(3-x/2)}]_n \quad (3)$$

where "x" ranges from 0.03 to 2.7, and "y" ranges from 0.01 to 0.8 and $n \geqq 2$;

and by mixtures of said compounds of formulas 1, 2 and 3. Preferably "x" is in the range of 0.2–2.2 and "y" is in the range of 0.02–0.3.

Therewith, the present invention provides a sizing dispersion and a process for sizing cellulose fiber material that reduces or eliminates the above described problems associated with the prior art, and more particularly it provides an application of said sizing dispersion that improves the long term resistance to edge penetration by lactic acid or hot hydrogen peroxide solutions after a coating or conversion process.

The sizing dispersion is added to the fibrous material in an amount of 0.01–10 wt %, calculated as dry sizing agent on dry cellulose fibers.

It has been observed that said dispersion used in the process for the manufacture of coated liquid packaging board confers on the edges thereof a high resistance to penetration by hot hydrogen peroxide and lactic acid that is maintained with the passage of time. Said dispersion also allows operations over a wide pH range (from 5 to 8). These surprising effects are even more unexpected, since it has been observed that the use of an synthetic sizing agent, such as AKD, a dispersion of rosin material and alumina or, alternatively, the use of combinations of rosin and synthetic sizing agents, such as those described in the above mentioned patents, does not lead to the same sizing effects.

The aluminum polymers described in formulas 2 and 3 contain, further to phosphate ions, hydroxy ions, chlorides, nitrates, formates, acetates and sulfates as counter ions.

The presence of phosphate in the above formulas is indicated as phosphoric acid, although in dilute or strongly basic aluminum polyphosphate solutions, part of the phosphate may be present as $H_2PO_4^-$. The factors "x" and "y" are independent of the way in which the phosphate is present.

Depending on the method followed in the production of the aluminum polyphosphate, this can contain a neutral salt such as a sulfate, chloride or formate of $Na^+$, $K^+$, $NH_4^+$, $Ca^{2+}$, or $Mg^{2+}$. The polyaluminum phosphates of the present invention may be prepared by means of the addition of aluminum metal to the solution of the corresponding aluminum salt, raising the resulting mixture to the boil, followed by a final addition of phosphoric acid.

The number of aluminum atoms in the compounds of general formulas 1, 2 and 3 depends, among other factors, on the concentration and the pH. The molar ratio of aluminum to the counter ion, with the exception of the hydroxy ions, should be at least 0.34:1 and preferably at least 0.65:1. Said compounds are substantially different from those described, for example, in WO 94/01619 and EP-0 062 015, especially aluminum polysulfates, which were not sufficiently stable, nor the corresponding sizing dispersions.

In the dispersions of the invention, the aluminum compound are present in a proportion of at least 5 wt %, more preferably 20–60 wt %, calculated as aluminum on rosin material in the sizing dispersion.

The sizing dispersion of the present invention comprises rosin material in combination with synthetic sizing agents.

The rosin material used in the dispersions of the invention should have a high free rosin content. Rosin and rosin material refer to the well-known types of pine rosin, denominated colophony (gum rosin, wood rosin), tall oil rosin and mixtures thereof. The rosin based sizing agent can be selected from among rosin, modified rosin, fortified rosin and mixtures thereof. Modified rosin is rosin that has been modified according to the state of the art, just as disproportionated rosin, hydrogenated rosin, polymerized rosin, esterified rosin, etc. The rosin material is preferably fortified rosin, i.e., the Diels-Alder adduct obtained in the well-known way by reacting the rosin, optionally modified as described, with an α,β-unsaturated carbonyl compound, such as pentaerythrite, fumaric acid, maleic acid or anhydrides thereof or acid esters of acrylic and methacrylic acid. In those dispersions according to the present invention, the degree of fortification of the rosin material can reach 16 wt % of the α,β-unsaturated carbonyl compound, based on the total weight of fortified rosin.

The amount of rosin component present in the rosin based sizing agent varies in the range of 25–80 wt % based on the total amount of rosin sizing agent. Preferably the rosin component is present in an amount ranging from 40 to 60 wt %

Further to the rosin material, the sizing dispersion of the present invention also comprises a synthetic sizing agent. Synthetic sizing agents are well known in the state of the art and preferably include at least one member of the group constituted by ketene dimers, acid anhydrides, organic isocyanates, carbamoyl chlorides and mixtures thereof. Ketene dimers (AKD) are the preferred choice.

The ketene dimers (AKD) have the following general formula:

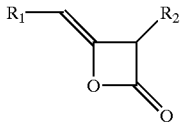

AKD where both $R_1$ and $R_2$ represent hydrocarbon groups with a number of carbon atoms ranging approximately from 6 to 30, being generally alkyl groups having from 12 to 20 carbon atoms, such as hexadecyl and octadecyl residues.

The disperse phase of the sizing composition of the present invention is formed by particles of rosin material, of the synthetic sizing agent or of a mixture of the rosin material and synthetic sizing agent, the mixture containing from 10 to 95 wt % of rosin. Since the particles contain a homogeneous mixture of the active sizing agents, the weight ratio in each particle of the dispersion will vary in the same range as indicated above.

The solids content of the dispersions of the invention is at least 1 wt % and preferably at least 5 wt %. The upper limit depends on the type of sizing agent employed and it is generally 60 wt %.

Dispersions of mixed particles are prepared without the use of dispersing agents or using one or several dispersing agents of the group of anionic, cationic or non-ionic dispersing agents. The amount of dispersing agent should be enough to give to the dispersions the desired stability. The upper limit is not critical, although an amount superior to 5 wt % is rarely used.

Cationic dispersing agents can be selected, for example, from dispersing agents that contain nitrogen, such as quaternary ammonium compounds and salts of tertiary amines. Protective colloids or retention agents, such as cationic starch, casein, cellulose derivatives, polyvinyl alcohols, polyacrylamides, polyethylene imines, polyamines, polyamidoamines, polyethylene amines or polyacrylates can also be included in the dispersions. Anionic surfactants can be selected from among alkyl sulfates, alkyl sulfonates, alkylaryl sulfonates, e.g., sodium laurylsulfate or sodium lignosulfonate. Non-ionic dispersing agents can be alkoxylated alcohols, alkylphenols and fatty acids, partial esters of fatty acids and polyvalent alcohols, with 2 to 8 carbon atoms, or anhydrous derivatives thereof and alkoxylated derivatives thereof.

The new aqueous cationic dispersions of rosin sizing agents can be prepared by means of the homogenization of the active substance in water in the presence of a dispersing agent with stirring and high temperatures, so that the disperse phase is constituted by fine particles. The active substance to be homogenized is a rosin component. The hot disperse phase is cooled and mixed with the aluminum compound. The final dispersion is homogenized.

Aqueous dispersions or emulsions of synthetic sizing agents are known in the state of the art and are available commercially. Such dispersions can be prepared in a conventional way, i.e., by mixing the synthetic sizing agent with an aqueous solution of the emulsifying or dispersing agent and treating the mixture with a homogenizer.

The dispersion of the invention can contain disperse particles of rosin sizing agent and disperse particles of synthetic sizing agents, or disperse particles of a mixture of rosin sizing agent and synthetic sizing agents, or a combination of the said disperse particles. The dispersions containing discrete particles of rosin sizing agent and synthetic sizing agents can be prepared by mixing preformed dispersions of rosin sizing agent with a preformed dispersion of the synthetic sizing agent. It is possible to modify the above process within the state of the art to which the invention belongs.

The above-described dispersions are particularly appropriate for the sizing of paper, cardboard, paper board and similar cellulose fiber products. The dispersions can be used in mass and surface sizing. They are preferably used in stock sizing and added in a conventional way. Conventional chemicals in the paper production, such as retention and/or draining agents, aluminum compounds, fillers, wet strength rosins, coloring agents, bleaching agents, etc., can be used with the present dispersions. The dispersions can be used in an amount of from 0.01 to 10 wt % of dry sizing agent relative to the dry cellulose fibers, preferably in an amount of 0.025 to 1 wt % of sizing agent.

The invention is illustrated with the following examples which, however, are not intended to limit it. Parts and percentages refer to parts by weight and percentages by weight respectively, unless otherwise specified.

EXAMPLE 1

100 parts of rosin and 8 parts of maleic anhydride were heated to 200° C. for 2 hours with stirring. The temperature was allowed to drop to 160–170° C. and 5 parts of a 20% sodium hydroxide solution were added with slow stirring. Finally, 50 parts of a 10% casein solution were added, with vigorous stirring. The final concentration was adjusted with water and the resulting emulsion was allowed to cool down.

EXAMPLE 2

50 parts of an emulsion according to Example 1 were mixed with strong stirring with 50 parts of an aluminum polyphosphate chloride solution containing 9% aluminum. The resulting emulsion was stirred for 1 hour.

EXAMPLE 3

50 parts of the rosin sizing emulsion of Example 2 were mixed with 50 parts of an AKD emulsion containing 15% of AKD wax, at 40° C. The resulting emulsion was stirred for 1 hour.

EXAMPLE 4

Board samples were prepared for use in the aseptic packaging of daily products. The original pulp was conventionally treated before being used in an also conventional paper machine. The board samples were formed by two layers. The upper layer was formed by a 70:30 mixture of bleached short fiber and long Kraft fiber (°SR 2235), with a weight of 55 g/m2. The lower layer was formed by 60% of unbleached long Kraft fiber and 40% of cuttings (°SR 1527), with a weight of 130 g/m2. The sheets were dried to a moisture content of 4.5–5.0% in the reel, some of the samples being coated (18 g/m2). The sizing dispersions were added just after the dilution pump.

The dispersion of Example 3 was compared with a traditional sizing system that uses an anionic rosin dispersion, an AKD dispersion and an aluminum salt. In the following Table the edge penetration values are shown for a 1% lactic acid solution at 25° C. for 60 min, according to the Tetra-pak standard, and for a 35% hydrogen peroxide solution at 70° C. for 10 min, in accordance with the Tetra-pak recommended process. It is also indicated whether the samples were coated or not.

TABLE I

| Dispersion | Surface treatment. | Edge absorption borders Lactic acid | Kg/m2 $H_2O_2$ |
|---|---|---|---|
| Example 3 | non coated | 0.45 | 0.95 |
| Example 3 | coated | 0.47 | 0.90 |
| Conventional (*) | non coated | 0.43 | 0.90 |
| Conventional (*) | coated | 0.50 | 2,10 |

(*) Conventional system: rosin emulsion, AKD emulsion and aluminum salt.

What is claimed is:

1. A process for the manufacture of coated liquid packaging board having improved long term resistance to edge penetration by lactic acid or hot hydrogen peroxide, which process comprises: (a) forming a sized board of cellulose fibers using a sizing dispersion containing an aqueous dispersion of rosin material, a ketene dimer (AKD) of formula

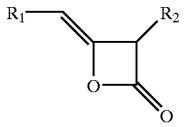

AKD wherein $R_1$, and $R_2$ are $C_6$–$C_{30}$ hydrocarbon groups as a sizing agent and from 20 to 60 wt % of an aluminum compound calculated as aluminum on rosin material in the sizing dispersion, wherein said aluminum compound is chosen from the group consisting of (1) aluminum sulfate; (2) aluminum polymers of general formula 1

$$[Al(OH)_x(A)_{(3-x)}]_n \quad (1)$$

where A=$Cl^-$, $NO_3^-$, $HCOO^-$, or $CH_3COO^-$;

(3) aluminum polymers of general formula 2

$$[Al(OH)_x,(H_3PO_4)_y(A)_{(3-x)}]_n \quad (2)$$

where A=$Cl^-$, $NO_3^-$, $HCOO^-$, or $CH_3COO^-$;

(4) aluminum polymers of general formula 3

$$[Al(OH)_x(H_3PO_4)_y\ (SO_4)_{(3-x/2)}]_n \quad (3)$$

where "x" ranges from 0.03 to 2.7, and "y" ranges from 0.01 to 0.8 and $n \geqq 2$; and (5) mixtures thereof, and (b) applying to the sized board a suspension containing at least a binder and a pigment to form a coated board.

2. The process of claim 1, wherein "x" ranges from 0.2 to 2.2; and "y" ranges from 0.02 to 0.3.

3. The process of claim 1 or 2, wherein the molar ratio of aluminum to the counter ion, with the exception of the hydroxy ions, is 0.34:1.

4. The process of claim 3, wherein the molar ratio of aluminum to the counter ion, with the exception of the hydroxy ions, is 0.65:1.

5. The process of claim 1, wherein said sizing dispersion is added to said cellulose fibers in an amount ranging from 0.01 to 10 wt %, calculated as drying sizing agent on dry cellulose fibers.

6. The process of claim 1, wherein the rosin material is fortified rosin, obtained by reaction of rosin and an α,β-unsaturated carbonyl compound.

7. The process of claim 6, wherein said α,γ-unsaturated carbonyl compound is fumaric acid, maleic acid or anhydrides thereof or acid esters of acrylic acid or methacrylic acid.

8. The process of claim 1, wherein said hydrocarbon groups of $R_1$, and $R_2$ are $C_{12}$–$C_{20}$ alkyl groups.

* * * * *

UNITED STATES PATENT AND TRADEMARK OFFICE

CERTIFICATE OF CORRECTION

PATENT NO. : 6,669,816 B1 
DATED : December 30, 2003
INVENTOR(S) : Juan José Costas Poch and Josep Lluis Bisbal Tudela It is certified that error appears in the above-identified patent and that said Letters Patent is hereby corrected as shown below:

Title page,
Item 57, ABSTRACT,
Line 8, "$[Al(OH)_x(H_3PO_4)_y(A)(_{3-x})]_n$" should read -- $[Al(OH)_x(H_3PO_4)_y(A)_{(3-x)}]_n$ --.
Line 11, "$[Al(OH)_x(H_3PO_4)_y(SO_4)_{(3-x/2)}]_n$" should read -- $[Al(OH)_x(H_3PO_4)_y(SO_4)_{(3-x)/2}]_n$ --.

Column 7,
Line 39, "$R_1$, and" should read -- $R_1$ and --.

Column 8,
Line 8, "$[Al(OH)_x,(H_3PO_4)_y(A)_{(3-x)}]_n$" should read -- $[Al(OH)_x(H_3PO_4)_y(A)_{(3-x)}]_n$ --.
Line 14, "$[Al(OH)_x(H_3PO_4)_y(SO_4)_{(3-x/2)}]_n$" should read -- $[Al(OH)_x(H_3PO_4)_y(SO_4)_{(3-x)/2}]_n$ --
Line 37, "α,γ-unsaturated" should read -- α,β-unsaturated --.
Line 43, "$R_1$, and" should read -- $R_1$ and --.

Signed and Sealed this

Eleventh Day of May, 2004

JON W. DUDAS
*Acting Director of the United States Patent and Trademark Office*